United States Patent [19]

Grangette et al.

[11] Patent Number: 4,543,195

[45] Date of Patent: Sep. 24, 1985

[54] FRICTION-REDUCING LUBRICATING COMPOSITIONS EACH COMPRISING AN ADDITIVE

[75] Inventors: Henri Grangette, Lyons; Bernard Constans, La Mulatiere; Paul Maldonado, St. Symphorien D'Ozon, all of France

[73] Assignee: Elf France, Paris, France

[21] Appl. No.: 522,240

[22] Filed: Aug. 11, 1983

[30] Foreign Application Priority Data

Aug. 11, 1982 [FR] France ..... 82 13986

[51] Int. Cl.[4] ..... C10M 1/32

[52] U.S. Cl. ..... 252/33.4; 252/56 R; 252/56 S

[58] Field of Search ..... 252/56 S, 56 R, 33.4

[56] References Cited

U.S. PATENT DOCUMENTS 3,714,042 1/1973 Greenough ..... 252/33.4

4,263,159 4/1981 Berens et al. ..... 252/56 S

*Primary Examiner*—John F. Niebling

*Attorney, Agent, or Firm*—Burgess, Ryan & Wayne

[57] ABSTRACT

The present invention concerns novel lubricating compositions effective in reducing friction, for use, particularly, in turning machines and remarkable in that the additive comprises by at least one mono- or di-substituted carboxylic acid substituted in the $\alpha$ or $\beta$ position with respect to the acid function.

6 Claims, No Drawings

FRICTION-REDUCING LUBRICATING COMPOSITIONS EACH COMPRISING AN ADDITIVE

BACKGROUND OF THE INVENTION

The present invention relates to novel lubricating composition effective in the reduction of friction or rubbing in turning machines operating in a mixed lubrication system, comprising an overbased lubricating oil and a small percentage of an additive compatible with this oil.

Overbased oils have already been used as a lubricant for turning machines, and, in particular, for internal combustion engines, whether operated with gasoline or of the diesel type. These overbased oils are characterized by a high T.B.N. (total basic number), for example, between 10 and 20. Their basic character allows to neutralization of the organic and mineral acids formed during thermal decomposition occuring in the lubricant. Generally, the basic character of these lubricants results from the presence of overbased calcium salts, for example, overbased calcium sulfonate or phenate.

DESCRIPTION OF THE PRIOR ART

In order to improve the properties of these lubricating compositions, diverse additives have been proposed. In particular, additives are known that allow to reduce their viscosity, which has a beneficial effect on fuel consumption. Such additives can, for example, constitute polymers having a considerable temporary shearing or, further, by low viscosity Newtonian liquids. However, the use of these additives does not overcome problems of metal-metal contact that arise when boundary lubrication occurs in which the load is no longer solely borne by the lubricating film but is shared between this fluid film and the asperities- or peaks- of the opposing surfaces. On the contrary, their viscosity-reducing action means that this boundary lubrication arises more easily, which thus results in increase in friction.

Furthermore, additives have been proposed that reduce the wear of the parts in contact during boundary lubrication. Zinc dialkyldithiophosphate is, in particular, known and gives good results as an anti-wear additive but can, in certain conditions, increase rubbing.

In an internal combustion engine and for the same quality of lubricating oil, the lubrication of various parts in contact can be made according to one or other of the lubricating regimes fluid film or boundary accordding to the temperature and the pressure of the contact regions involved.

In particular, in the regions where conditions are extreme, as for example, at the level of cam-skate of the distributors of the head camshaft, at the level of the head push-rod bearings, or at the level of the piston rings cylinder shirt contacts, more particularly at the end of the compression stroke of the pistons, the lubrication is generally boundary i.e. there are metal-metal contacts, whereas in the regions where the temperature is lower, there is a fluid film system. It will thus be understood that the choice of an additive muust be such that said additive is not detrimental in one given system, whereas it gives good performance in another.

Furthermore, it is necesary that all the additives present in one lubricating system are compatible with one another and at all temperatures that can be reached during utilisation. in particular, it is necessary to prevent the formation of insoluble componds such as calcium carboxylates that can provoke the flocculation of certain polymers as, for example, those used to improve the viscosity index.

SUMMARY OF THE INVENTION

These different problems are overcome by the present invention that concerns a lubricating composition comprising a novel additive, compatible with the lubricating oil and its other additives, that diminishes the coefficient of friction in boundary lubrication, this additive, furthermore, having no detrimental influence on the other properties of the lubricating composition.

DETAILED DESCRIPTION OF THE INVENTION

In order to do this, the invention relates to a novel lubricating composition effective as a friction reducer, comprising an overbase lubricating oil and a small percentage of an additive compatible with this oil, this additive constituting one or several carboxylic acids, substituted in position $\alpha$ or $\beta$ with respect to the acid function, represented by the general formula:

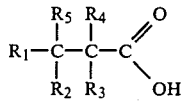

wherein $R_1$, $R_2$, $R_3$, $R_4$ and $R_5$ are identical or different and represent a $C_1$ to $C_{22}$ saturated or unsaturated hydrocarbon radical or hydrogen.

Preferably, the additive is present in the lubricating oil in proportions between 0.1 and 5% by weight.

These carboxylic acids substituted in position $\alpha$ or $\beta$ with respect to the acid function have the advantage that the sterical hindrance created by the substituent prevents a reaction of the acid function to be initiated on the various chemicals surrounding it, so that they present a considerable inertia with respect to these chemicals, for example, with respect to the calcium sulfonates which can be present in the lubricating composition.

In a preferred realization, radical R comprises six or more carbon atoms and, especially, 13 to 19 carbon atoms.

Among the $\beta$-substituted carboxylic acids, 3,3 dimethyl butyric acid is particularly advantageous for realizing the invention. This acid can be obtained by any method known per se. In particular, it is possible to use a synthesis having several steps or a direct method by action of a vinylidene chloride on various functional compounds in the presence of gaseous $BF_3$ and sulfuric acid, such as described in the article of K. BOTT and H. HELLMAN Angew. Chem 78, 932, (1966), or, furthermore, in the presence of $BF_3$ dihydrate, as described in the article ACTA. CHEM. SCAND. 621. 1980.

The $\alpha$-substituted acids can be obtained by any synthesis method known per se, in particular, by the action of an $\alpha$-olefin or an $\alpha$-olefin cut on an fatty carboxylic acid, in particular a $C_{15}$ to $C_{20}$ $\alpha$-olefin cut, in the presence of peroxide.

The $\alpha$-di-substituted carboxylic acids can, in particular, be obtained by methods allowing their synthesis in mild conditions, departing from certain functional derivatives such as olefins, alcohols or halogenides and which foresee the use, in a concentrated sulfuric medium, of formic acid as CO source. (W. HAAF, H. KOCH, Ann. 68-251, (1958). It is, however, also possible to use any other known method.

The invention will be better understood by reading the following examples, given by way of non-limitative illustration. These examples have been realized so as to clearly show the good qualities of the lubricating compositions according to the invention.

In order to study the properties of the lubricating composition, a series of examples has been realized for which several tests were carried out.

The first of these tests consists in verifying the compatibility of the additive with the oil and its components. To achieve this result, the lubricating composition containing the friction reducing additive is brought to a temperature of about 120° C. during about 1 hour and it is checked that this test is negative, i.e. that there is no gaseous release nor precipitation.

Thereafter, the thermal stability is measured according to a differential thermal analysis method that consists, in a classical manner, in determining the induction time at 220° C. under oxygen atmosphere. This measurement is made of a composition containing the additive and for test purposes with a composition without additive and the two measurement are compared.

A third measurement consists in determining the rate of friction reduction; this rate is defined as being the relative decrease of friction of the additive containing oil with respect to the reference oil.

In order to measure this rate, rotative assembly, that is lubricated by the composition to be tested, is rotary driven by a variable-speed electric motor that is caused to turn constant speed.

For each composition tested, the value of the intensity of the current passing in the motor is measured, this intensity varying, at constant speed, with the friction exerted by the turning assembly. It is obvious that in order to have good representative results, lubricating conditions must be identical, in particular, the oil feed pressure and the temperature, as well as the speed of the motor.

EXAMPLE 1

This example concerns the lubricating compositions in which the additive constitutes a mixture of carboxylic acids substituted in position $\alpha$ or $\beta$ with respect to the acid function, these acids being obtained through the action of a linear acid

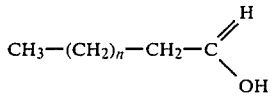

on a $C_{15}$–$C_{20}$ $\alpha$- olefin cut $R^1$—CH=$CH_2$ ($R^1$ hydrocarbon radical comprising of 13 to 18 carbon atoms). The operating conditions are the following : an excess of carboxylic acid is used; the acid, olefins and peroxide are introduced in respective molar proportions 10:1:0.25. The reaction i conducted at reflux temperature between 120° and 180° C. The olefins and the peroxide are added progressively over 6 hours so as to take into account the exothermicity of the reaction. The yield is about 60%.

Three products were thus synthesized for which n was respectively 6, 13 and 19 and were successively mixed with an SAE 15W 40 grade lubricating oil in a quantity of 1% by weight, so as to obtain three lubricating compositions.

A verification was made for these three compositions and the compability test was negative.

The values obtained for the reduction of coefficients of friction induction time are set out in TABLE I herein-below.

TABLE I

| | Reduction of coefficient of friction % | induction time reference oil:43 mn |
|---|---|---|
| n = 6 | 6 | 31 |
| n = 13 | 7 | 30 |
| n = 19 | 13 | 31 |

EXAMPLE 2

This example relates to 3—3 dimethylbutyric acid. In order to test the composition 1% volume of 3—3 of di-methylbutyric acid was mixed with a lubricating oil identical to that used in Example 1, and containing, furthermore, 10% overbased calcium sulfonate.

After the solution has been maintained at 120° C. during 1 hour, no precipitation, nor gaseous release was observed.

Comparative test: the same compatibility test was carried out on a composition comprising, in the same lubricating oil, 1% volume of n-hexanoic acid

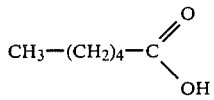

i.e. a non substituted carboxylic acid. The formation of an abundant precipitate and a gaseous release were observed.

This example clearly shows the role fulfilled by the sterical hinderance of the substituent group of the acid.

The results of the tests carried out on the lubricating composition containing this libricating composition appear in TABLE II herein-below:

TABLE II

| Reduction of coefficient of friction 0.5% adjuvant | induction time (mn) reference oil:43 1% adjuvant |
|---|---|
| 6 | 43 |

It is thus observed that this composition is as stable to oxidation as the composition without an additive.

EXAMPLE 3

This example concerns a lubricating composition in which the additive used is a trimethylacetic acid.

A composition comprising X% additive by weight in SAE 15W 40 grade lubricating oil is realized.

It was verified that the compatibility test was negative.

The following results were obtained for the reduction of coefficients of friction and induction times for X=0.5% and X=1%.

| reduction of coefficient of friction | | induction time (mn) oil reference:48 |
|---|---|---|
| X = 0.5% | X = 1% | 1% adjuvant |
| 5 | 8 | 37 |

The present invention is, of course, in no way limited to the embodiments described herein-above but covers all variations available to the man skilled in the art, without departing from the spirit and scope of the said invention.

We claim:

1. A lubricating composition effective as a friction reducer comprising an overbased lubricating oil and a small percentage of an additive compatible with the oil, wherein the additive comprises at least one carboxylic acid substituted in positions $\alpha$ or $\beta$ with respect to the acid function, represented by the formula:

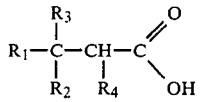

wherein $R_1$, $R_2$, $R_3$ and $R_4$ are independently each a saturated or unsaturated $C_1$ to $C_{22}$ hydrocarbon radical or hydrogen wherein when $R_1$ is a hydrocarbon radical, at least one of $R_2$, $R_3$ or $R_4$ is a hydrocarbon radical and when $R_1$ is hydrogen, at least $R_4$ or $R_2$ and $R_3$ are hydrocarbon radicals.

2. A lubricating composition according to claim 1, wherein the additive is present in proportions between 0.1 and 5% by weight.

3. A lubricating composition accordingt to claim 1, wherein the additive is an $\alpha$-substituted acid obtained by the reaction of a linear carboxylic acid and at least one alpha-olefin.

4. A lubricating composition according to claim 1, wherein the additive is an $\alpha$-substituted acid obtained by the reaction of a linear carboxylic acid and a $C_{15}$ to $C_{20}$ alpha-olefin cut.

5. A lubricating composition according to claim 1, wherein the additive is a $\beta$-substituted acid.

6. A lubricating composition of claim 5 wherein the additive is 3,3-dimethylbutyric acid.

* * * * *